US005358235A

United States Patent [19]

Konno et al.

[11] Patent Number: 5,358,235

[45] Date of Patent: Oct. 25, 1994

[54] SHEET FEEDING APPARATUS

[75] Inventors: Shinobu Konno; Masaru Ushio, both of Tokyo, Japan

[73] Assignee: Konica Corporation, Tokyo, Japan

[21] Appl. No.: 86,165

[22] Filed: Jul. 1, 1993

[30] Foreign Application Priority Data

Jul. 21, 1992 [JP] Japan ..... 4-215649

[51] Int. Cl.[5] ..... B65H 7/14

[52] U.S. Cl. ..... 271/227; 271/242; 271/263

[58] Field of Search ..... 271/227, 228, 236, 242, 271/263

[56] References Cited

U.S. PATENT DOCUMENTS 4,685,664 8/1987 Petersdorf ..... 271/227
4,708,456 11/1987 Shibata ..... 271/227 X
4,986,527 1/1991 Ogoda ..... 271/274 X
5,080,347 1/1992 Funada ..... 271/227 X
5,140,166 8/1992 Gerlier ..... 271/227 X

*Primary Examiner*—Richard A. Schacher
*Attorney, Agent, or Firm*—Frishauf, Holtz, Goodman & Woodward

[57] ABSTRACT

A sheet feeder for stopping a conveyance of a sheet at a registration location. The sheet feeder includes: registration rollers, positioned at a registration location, for stopping a conveyance of a sheet; buckling rollers for conveying the sheet toward the registration rollers, and for conveying the sheet so that said sheet has a pressure contact with the pair of buckling rollers; a photosensor for detecting a leading edge of the sheet at a predetermined location, and for generating an edge detection signal; a driver for releasing the pressure contact of the sheet with the pair of buckling rollers; and a controller for controlling the driver to release said sheet based on the edge detection signal.

4 Claims, 3 Drawing Sheets

SHEET FEEDING APPARATUS

BACKGROUND OF THE INVENTION

The present invention relates to a sheet feeding apparatus that feeds and transports a transfer sheet to a transfer processing unit in an image forming apparatus such as an electrophotographic copying machine, and more particularly to a sheet feeding apparatus that is positioned immediately before a transfer processing unit to feed out a transfer sheet after synchronizing the transfer sheet with the transfer processing unit by regulating the position and direction of the transfer sheet.

For the purpose of timely transfer of toner images formed on a photoreceptor, a transfer sheet in an electrophotographic copying machine is stopped temporarily at registration rollers positioned immediately before the transfer processing unit in the conveyer path to the photoreceptor where a position and a conveyance timing of said transfer sheet are adjusted. Then, the registration rollers are rotated in synchronization with the rotation of the photoreceptor to move the transfer sheet that is nipped between the registration rollers to a transfer area after optical scanning is started and toner images are formed on the photoreceptor.

At the registration rollers, the leading edge of the transfer sheet transported by buckling rollers 10 positioned at the upstream side is caused to hit the registration rollers to stop. Even after the transfer sheet is stopped, the buckling rollers keep rotating for a predetermined time so that a bulge of the transfer sheet may be formed. Utilizing the elasticity of the bulge, the leading edge of the transfer sheet is inserted into the nip portion of the registration rollers which are to be started, and then the buckling rollers and the registration rollers are rotated synchronously relative to each other to convey move the transfer sheet. Therefore, a substantial part of the bulge formed by the transfer sheet excluding the portion inserted when the registration rollers are rotated remains as it is. Thus the registration rollers and the buckling rollers convey the transfer sheet while keeping the bulge.

However, the bulge of the transfer sheet is not necessarily formed uniformly. Therefore, there has been a fear that the transfer sheet will receive unnecessary stress when it is transported while the bulge is kept, and that a plosive noise is produced when the transfer sheet is pulled. Further, when jamming takes place in a conventional sheet feeding apparatus, buckling rollers have needed to be released manually from their pressure contact for clearing the jammed sheet and therefore the sheet feeding apparatus has needed to be opened for each occurrence of a jam.

An object of the invention is to provide a sheet feeding apparatus wherein pressure contact of buckling rollers is released on a timely basis, thereby a bulge of a transfer sheet is eliminated, the transfer sheet is free from unnecessary stress, the noise level is low and jam clearance is easy.

SUMMARY OF THE INVENTION

For solving the problems mentioned above, an example of a sheet feeding apparatus comprising a pair of buckling rollers which nip a transfer sheet and convey it, a leading-edge-detection sensor that detects the leading edge of the transfer sheet being conveyed, registration rollers which are hit by the transfer sheet for registration of the leading edge and which transports the registered transfer sheet to a transfer section, and a control means connected to the buckling rollers, the leading-edge-detection sensor and the registration rollers, wherein the buckling rollers have a pressure-contact-releasing means that is connected to the control means and is capable of releasing a pressure contact between the buckling rollers based on output from the leading-edge-detection sensor.

In the sheet feeding apparatus of the invention, the pressure-contact-releasing means mentioned above may also be provided with a supporting plate that supports one shaft of the buckling rollers, a pivotal axis on which the supporting plate is supported pivotally, and an eccentric cam that contacts the supporting plate or a member connected to the supporting plate, said cam rotating through a predetermined angle owing to the control of the control means in order to swivel the supporting plate and thereby release the pressure contact with the buckling rollers, in the sheet feeding apparatus of the example mentioned above.

In the sheet feeding apparatus of the invention, the buckling rollers and/or the registration rollers may also be provided with a jam detection means and thereby the control means may output signals for releasing the pressure contact between the buckling rollers to the control means in the case of an occurrence of jamming in the sheet feeding apparatus of the example mentioned above.

In the sheet feeding apparatus of the present example, a transfer sheet is nipped between a pair of buckling rollers which transport the transfer sheet to registration rollers. When the leading edge of the transfer sheet is detected by a leading-edge-detection sensor, signals are sent to a control means and thereby the buckling rollers keep rotating for a predetermined period of time to cause the transfer sheet to hit the registration rollers for positioning of the leading edge and consequent registration of the transfer sheet and to cause the transfer sheet to form a bulge. After that, when the registration rollers are started and the transfer sheet is nipped, the control means drives a pressure-contact-releasing means to release the pressure contact between the buckling rollers. In this case, the bulge of the transfer sheet is eliminated and the transfer sheet is transported, with its trailing edge which is free, to a transfer section.

In a pressure-contact-releasing means of the sheet feeding apparatus, when registration rollers are started and a transfer sheet is nipped, a control means rotates an eccentric cam through a predetermined angle so that it may swivel a supporting plate that supports one shaft of buckling rollers or a member connected to the supporting plate, while keeping into contact with it, around a pivotal axis as a center for swiveling. In this case, the other shaft of the buckling rollers moves along a locus in shape of a circular arc around the pivotal axis as a center of the circular arc, and releases the pressure contact of the buckling rollers. When the transfer sheet is fed out, the eccentric cam rotates again to return the other shaft in buckling rollers mentioned above to the original position to create the state of the pressure contact again.

In the sheet feeding apparatus, further, when jam detection means provided on the buckling rollers and/or registration rollers send jam occurrence signals to a control means, the control means outputs to a pressure-contact-releasing means the signals for releasing the pressure contact between buckling rollers. Owing to this, a transfer sheet can easily be removed when it becomes unable to be transported.

DETAILED DESCRIPTION OF THE INVENTION

Figure 1:
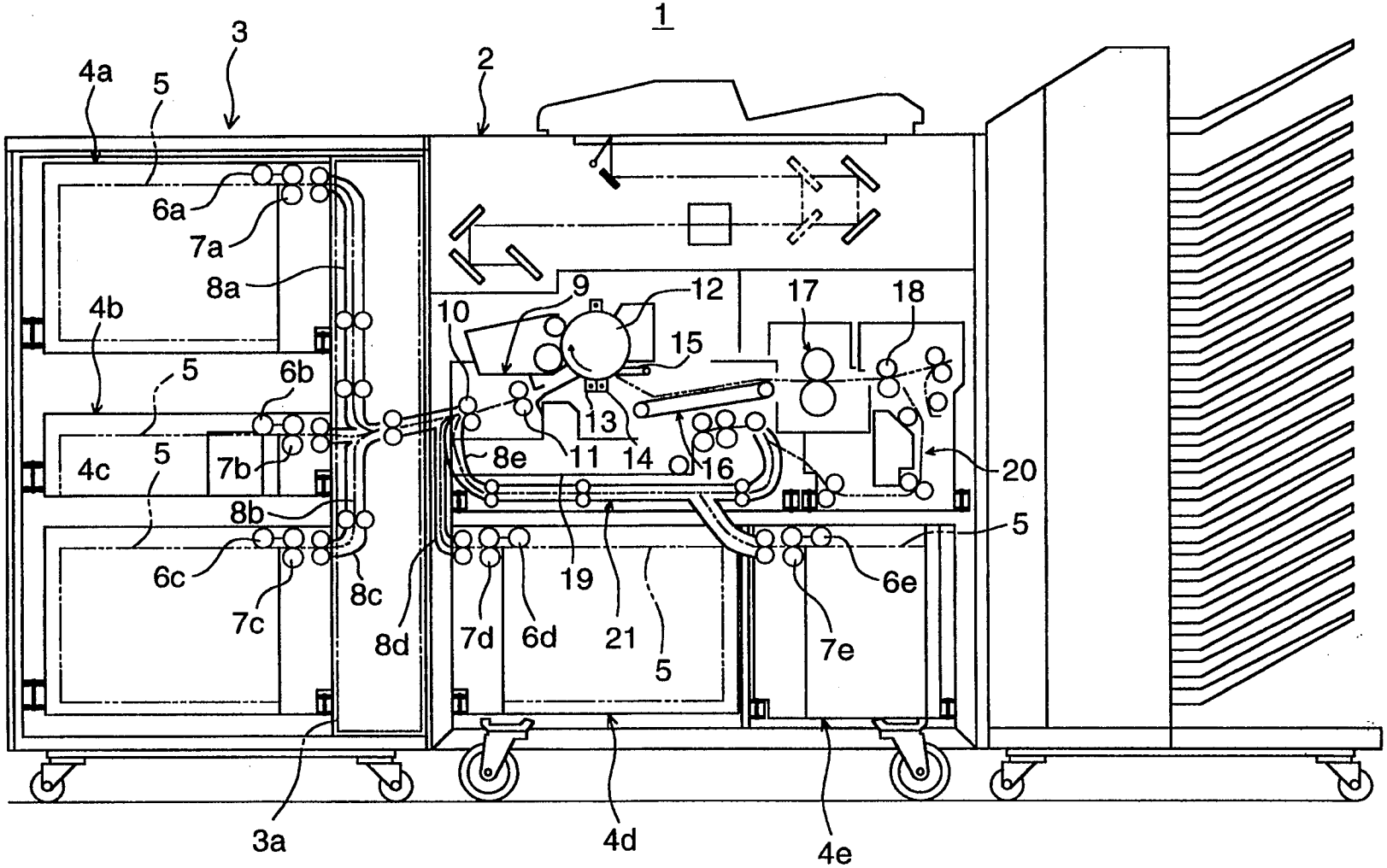
FIG. 1 is a schematic structural diagram of an image forming apparatus having therein a built-in sheet feeding apparatus.
Figure 2:
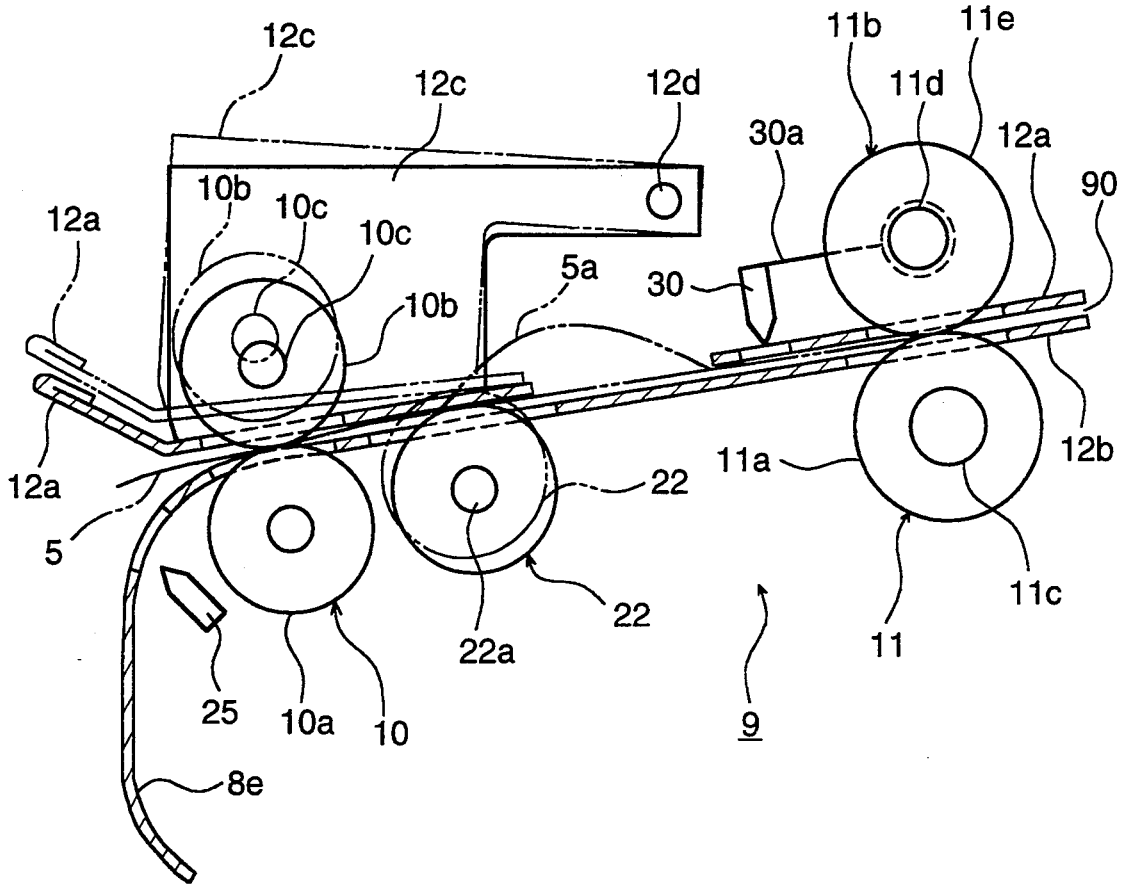
FIG. 2 is a side view of a second sheet feeding unit that constitutes the sheet feeding apparatus.
Figure 3:
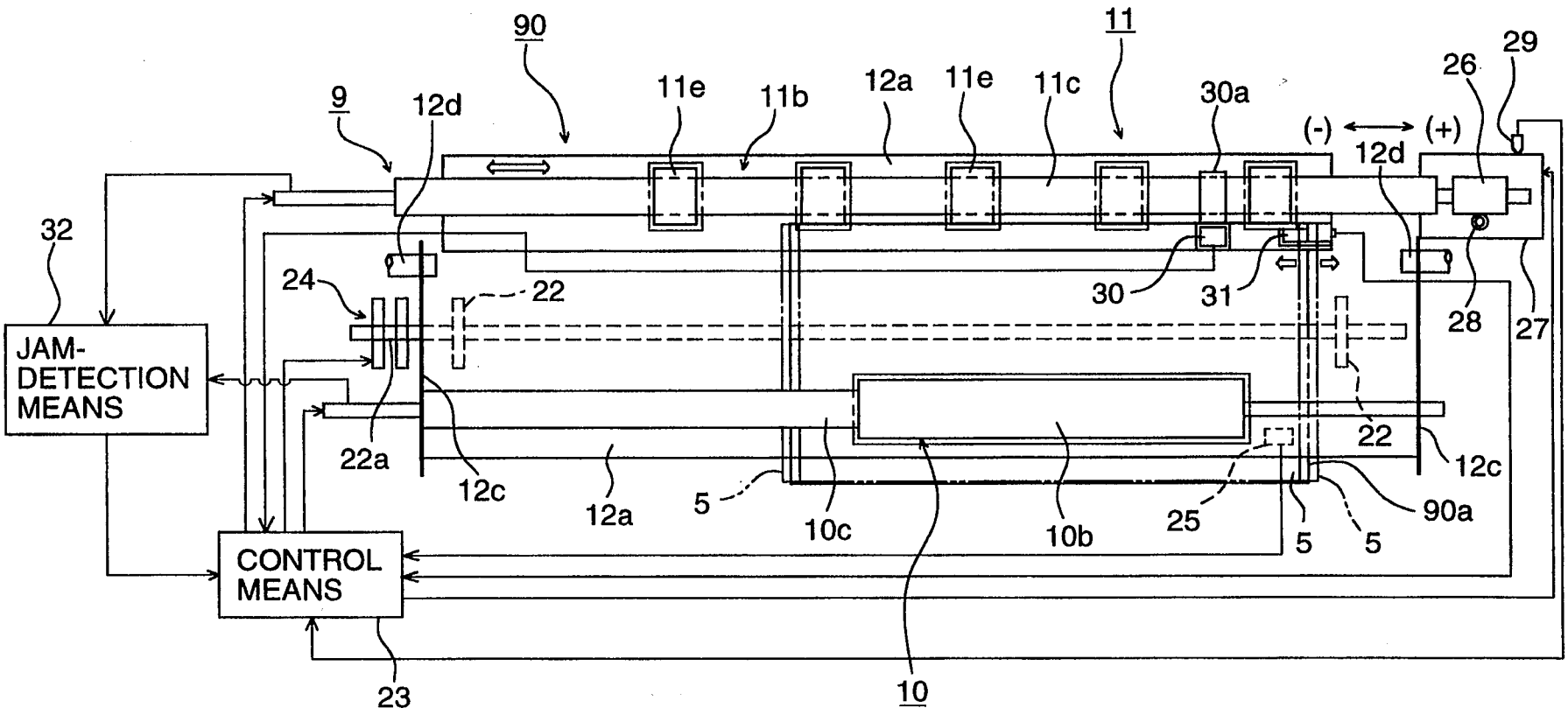
FIG. 3 is a top view of the second sheet feeding unit that constitutes the sheet feeding apparatus.

Next, an example of the sheet feeding apparatus of the invention will be explained, referring to the diagrams attached. FIG. 1 is a schematic structural diagram of an image forming apparatus having therein a built-in sheet feeding apparatus, FIG. 2 is a side view of a second sheet feeding unit that constitutes the sheet feeding apparatus and FIG. 3 is a top view thereof. The image forming apparatus 1 is provided with apparatus main body 2 and sheet feeding unit 3 connected to the apparatus main body 2. Both of the apparatus main body 2 and the sheet feeding unit 3 are provided with sheet feeding decks. The sheet-feeding unit 3 is provided therein with first sheet feeding deck 4*a*, second sheet feeding deck 4*b* and third sheet feeding deck 4*c* in this sequence from the top, and each deck contains transfer sheet 5. On the upper surface of the transfer sheet 5 in each of the sheet feeding decks 4*a*, 4*b* and 4*c*, there is arranged each of sheet feeding rollers 6*a*, 6*b* and 6*c* for feeding out the transfer sheet 5 intermittently. The sheet feeding rollers 6*a*, 6*b* and 6*c* are provided respectively with double-feed-prevention means 7*a*, 7*b* and 7*c*, thereby the transfer sheet is fed out to the following step one sheet by one sheet. Similarly, the apparatus main body 2 too is provided with fourth sheet feeding deck 4*d* and fifth sheet feeding deck 4*e* each of which contains transfer sheet 5. These sheet feeding decks 4*d* and 4*e* are also provided respectively with sheet feeding rollers 6*d* and 6*e* as well as double-feed-prevention means 7*d* and 7*e*. The transfer sheet 5 fed out of each sheet feeding deck is led successively by guide plates 8*a*, 8*c*, 8*d* and 8*e*, and transported to second sheet feeding unit 9 that constitutes the sheet feeding apparatus built in the apparatus main body 2.

The second sheet feeding unit 9 is arranged immediately before a transfer process unit and is provided with buckling rollers 10 and registration rollers 11. The registration rollers 11 are hit by a transfer sheet 5 and stop it, correct the leading edge of the transfer sheet 5 to the direction perpendicular to the advancing direction of the transfer sheet 5, and feed it to a transfer area in a transfer unit, after a predetermined period of time. The transfer sheet 5 passes through photoreceptor 12, transfer electrode 13 and separation electrode 14 all constituting the transfer unit, thereby carries toner images, and is placed on transport unit 16 through separation claw 15, and then transported to fixing unit 17. The toner images on the transfer sheet heated and pressed in the fixing unit 17 are fixed, and the transfer sheet 5 is then nipped by transport rollers 18 and sent to an unillustrated ejection tray in the case of one-side copying. In the case of two-side copying, the transfer sheet 5 is fed into automatic reversing-sheet-ejection unit 20 that is connected with storage tray 19 at which the transfer sheet 5 having on its one side the fixed images and coming from the transport rollers 18 stays temporarily. The transfer sheet 5 which has stayed temporarily in the storage tray 19 is fed out again to be transported to the second sheet feeding unit 9 through transport path 21 and guide plate 8*e*. Incidentally, transfer sheet 5 contained in the fifth sheet feeding deck 4*e* also uses the transport path 21 in combination.

The structure of the second sheet feeding unit 9 will be explained in detail next, referring to FIG. 2 and FIG. 3. The second sheet feeding unit 9 is provided with sheet transport path 90 formed by upper guide plate 12*a* and lower guide plate 12*b* both facing each other with a predetermined distance between them. At the downstream side of the sheet transport path 90, there are positioned buckling rollers 10, and at the upstream side thereof, there are positioned registration rollers 11. The buckling rollers 10 include, at its lower side, driving roller 10*a* positioned at the lower side of the buckling rollers and rotated by an unillustrated main driving motor and driven roller 10*b* positioned at the upper side thereof. Both ends of shaft 10*c* of the driven roller 10*b* are pivotally supported by two side plates 12*c* and 12*c* both protruded from upper guide plate 12*a*. Both side plates 12*c* and 12*c* are structured to be rotatable respectively around pivotal supports 12*d* and 12*d*. When it swivels upward, the driven roller 10*b* pivotally supported is separated from the driving roller 10*a* and thus the pressure contact between them is released. Two eccentric cams 22 and 22 are in contact with the lower surface of the guide plate 12*a* so that the side plates 12*c* and the upper guide plate 12*a* may swivel around the pivotal supports 12*d*. On the end of shaft 22*a* on which the eccentric cam 22 is affixed, there is provided clutch 24 that is driven by an unillustrated main driving motor and is controlled by control means 23 to be on and off. At the upstream side and immediately before the buckling rollers 10, there is provided intermediate photosensor 25 which outputs to the control means 23 the detection signals of the trailing edge of transfer sheet 5. The control means 23 also controls how the buckling rollers 10 are driven.

Registration rollers 11 are composed of driving roller 11*a* positioned at the lower side of the registration rollers and driven roller 11*b* positioned at the upper side thereof, and their shafts 11*c* and 11*d* are supported by unillustrated bearing members so that the shafts may slide axially. At an end of each of shafts 11*c* and 11*d*, there is provided rack 26 which is engaged with driving gear 28 that is driven by swiveling motor 27 connected with control means 23. When the swiveling motor 27 is driven to rotate in the regular direction and the reverse direction, shafts 11*c* and 11*d* are moved axially through the rack 26. On the end of the rack 26, there is provided home-position-photosensor 29 which detects positions of the shafts 11*c* and 11*d* and sends signals of the detection to the control means 23. On the shaft 11*d* of the driven roller 11*b*, there are affixed a plurality of rollers 11*e* at a certain interval, and at the upstream side between the rollers 11*e*, there is provided registration-photosensor 30 which receives light reflected on transfer sheet 5 and outputs signals for controlling registration rollers 11 to the control means 23. The registration-photosensor 30 is affixed on the shaft 11*d* with metal fixture 30*a* so that the registration-photosensor may act solidly and synchronously with swiveling of the shaft 11*d*.

On sheet transport path end 90*a* of the sheet-transport-path 90 located at the upstream side and immediately before the registration rollers 11, there is provided side-end-detection sensor 31 which outputs signals of existence of an edge of transfer sheet 5 to the control means 23. The side-edge-detection sensor 31 consists of photosensors of a transmission type wherein a light-emitting member and a light-receiving member are arranged so that they face each other sandwiching the sheet-transport-path 90. On each of buckling rollers 10 and registration rollers 11, there is provided jam-detection means 32 which outputs jam-occurrence signals to the control means 23.

Next, operations of the second sheet feeding unit 9 will be explained as follows. The transfer sheet 5 fed out from each of sheet feeding decks 4*a*, 4*b*, 4*c*, 4*d* and 4*e* or from storage tray 19 is guided successively by guide plates 8*a*, 8*b*, 8*c*, 8*d* and 8*e* to be transported to the second sheet feeding unit 9. In this case, driving roller 10*a* and driven roller 10*b* of buckling rollers 10 are in pressure contact each other and they transport the transfer sheet 5 to registration rollers 11 for feeding therein along sheet-transport-path 90, being driven by an unillustrated main driving motor. When the leading edge of the transfer sheet 5 is detected by registration-photo-sensor 30 positioned immediately before the registration rollers 11, signals of the detection are outputted to the control means 23. Then, the control means 23 causes the buckling rollers 10 to stop rotating. During this period, the leading edge of the transfer sheet 5 hits roller 11*e* of the registration rollers 11 and is corrected to the direction perpendicular to its advancing direction, while bulge 5*a* as shown in FIG. 2 is formed through driving of the buckling rollers 10.

When the registration rollers 11 are driven by the use of reaction force of the bulge 5*a*, the leading edge of the transfer sheet 5 is inserted surely into the nip portion of the roller 11*e* of the registration rollers 11. In succession to the above, the registration rollers 11 and buckling rollers 10 are driven again and the transfer sheet 5 is fed to a transfer process section which is a following step. Then, after a time lag generated electrically or mechanically, the control means 23 sends clutch-engagement signals to clutch 24 so that the clutch 24 may be engaged to rotate eccentric cam 22 through a half turn. Then, upper guide plate 12*a* that is pushed up by the eccentric cam 22 is caused to swivel upward together with side plate 12*c* around pivotal support 12*d* to separate pivotally-supported driven roller 10*b* from driving roller 10*a*, thus, the transfer sheet 5 is freed from being nipped by rollers and the bulge is eliminated. Therefore, the trailing edge of the transfer sheet 5 is freed and the noise level caused by sheet transportation is lowered.

In the case where an edge of the transfer sheet 5 whose trailing edge is free is not detected by side-edge-detection sensor 31, driving signals which drive the swiveling motor 27 to rotate in one direction are sent from the control means 23, thereby the registration rollers 11 are slid in the (+) direction shown in FIG. 3 through rack 26 and driving gear 28. This sliding of the registration rollers 11 can be smooth owing to that the trailing edge of the transfer sheet 5 is free, and there is no fear that the transfer sheet 5 will be under unnecessary stress. When the side-edge-detection sensor 31 detects the sheet edge, swiveling motor 27 is stopped. In the case where the sheet edge is detected by the side-edge-detection sensor 31 while the leading edge of the transfer sheet 5 is nipped by the registration rollers 11, the swiveling motor 27 is rotated in the direction opposite to the foregoing and thereby the registration rollers 11 are slid in the (−) direction shown in FIG. 3.

In this case, the relative position between the transfer sheet 5 to be detected in the course of sliding and registration-photo-sensor 30 remains the same because the registration-photo-sensor 30 is so mounted that it may swivel integrally with the swiveling registration rollers 11. Therefore, the reflection angle relating to the transfer sheet 5 transported thereafter to the transfer process section also remains the same, and output from the registration-photo-sensor 30 can be stabilized.

After the transfer sheet 5 has been transported to the following step, home-position-photo-sensor 29 detects the position of an end of rack 26 and sends signals of the detection to the control means 23 so that the swiveling motor 27 may be driven again to return the registration rollers 11 to their home position. During this period, the control means 23 sends clutch-engagement signals to clutch 24 again, rotates eccentric cam 22 through a half turn, lowers the upper guide plate 12*a* so that the driven roller 10*b* can be brought into pressure contact with the driving roller 10*a* to be ready for transportation of the succeeding transfer sheet 5.

When it is impossible to transport the transfer sheet 5 due to jamming caused on buckling rollers 10 or on registration rollers 11, jam-detection means 32 outputs jam-occurrence signals to the control means 23. The control means 23 controls clutch 24 to separate driven roller 10*b* from driving roller 10*a*, thereby to free the transfer sheet 5 from being nipped by the rollers for removing the transfer sheet 5 that can not be transported. When the transfer sheet 5 fed out of sheet feeding unit 3 becomes unable to be transported at the second sheet feeding unit 9, door 3*a* for maintenance use on the sheet feeding unit 3 shown in FIG. 1 is opened, through which a hand is thrust in for taking out the transfer sheet 5 which can not be transported. In this case, the buckling rollers 10 have automatically been freed from pressure contact due to jam-occurrence signals. Therefore, it is easy to clear the jam.

As stated above, the present invention can offer a sheet feeding apparatus wherein a bulge formed by a transfer sheet that is nipped by registration rollers may be eliminated, unnecessary stress is given to the transfer sheet when it is fed out and a noise level is low, because a pressure-contact-releasing means is provided in the invention so that pressure contact between buckling rollers may be eliminated. Owing to the constitution wherein an eccentric cam is used so that one of shafts for the buckling rollers may be swiveled, it is possible to eliminate pressure contact between buckling rollers surely by means of a simple apparatus. Owing to further arrangement of a jam-detection means and a pressure-contact-releasing means, it is not necessary to release buckling rollers from pressure contact manually in the case of occurrence of jamming, but it is possible to remove the jammed transfer sheet quickly.

What is claimed is:

1. A sheet feeding apparatus for stopping a conveyance of a sheet at a registration location, comprising:

registration means, provided at the registration location, for at least one of stopping and allowing a conveyance of the sheet;

conveying means for conveying said sheet toward said registration means, said conveying means including a pair of conveyance rollers for conveying said sheet, said pair of conveyance rollers being in a releasable pressure contact with said sheet;

detecting means for detecting a leading edge of said sheet, said detecting means being positioned before said registration means, when viewed in a conveyance direction of said sheet, said detecting means generating an edge detection signal upon detection of said leading edge of said sheet;

releasing means for releasing said pressure contact of said pair of conveyance rollers with said sheet; and control means for controlling said releasing means based on said edge detection signal; and wherein:

said control means controls said releasing means to release said pressure contact of said pair of conveyance rollers with said sheet when said registration means allows a conveyance of said sheet at said registration location.

2. The apparatus of claim 1, wherein said releasing means comprises;

a supporting plate member for supporting one of said pair of conveyance rollers;

an axis for pivotally supporting said supporting plate member; and an eccentric cam member for rotating said supporting plate member about said axis.

3. The apparatus of claim 1, further comprising:

jam detecting means for detecting a sheet jam at at least one of said registration means and said conveying means, and for generating a jam detection signal when a sheet jam is detected; and wherein said control means controls said releasing means based on said jam detection signal.

4. A sheet feeding apparatus for stopping a conveyance of a sheet at a registration location, comprising:

registration means, provided at the registration location, for at least one of stopping and allowing a conveyance of the sheet;

conveying means for conveying said sheet toward said registration means, said conveying means including a pair of conveyance rollers for conveying said sheet, said pair of conveyance rollers being in a releasable pressure contact with said sheet;

detecting means for detecting a leading edge of said sheet, said detecting means being positioned before said registration means, when viewed in a conveyance direction of said sheet, said detecting means generating an edge detection signal upon detection of said leading edge of said sheet;

releasing means for releasing said pressure contact of said pair of conveyance rollers with said sheet; and control means for controlling said releasing means based on said edge detection signal; and wherein:

said control means controls said releasing means to release said pressure contact of said pair of conveyance rollers with said sheet when said registration means allows a movement of said sheet at said registration location; and said conveying means conveys said sheet toward said registration means so that said sheet is buckled when said sheet is stopped by said registration means to form a bulge to position said leading edge of said sheet before said releasing means releases said pressure contact of said sheet with said pair of conveyance rollers.

* * * * *